US005938417A

United States Patent [19]

Takao et al.

[11] Patent Number: 5,938,417

[45] Date of Patent: Aug. 17, 1999

[54] SCROLL TYPE FLUID MACHINE HAVING WRAPS FORMED OF CIRCULAR ARCS

[75] Inventors: Kunihiko Takao, Tsuchiura; Hirokatsu Kohsokabe, Ibaraki-ken; Masahiro Takebayashi; Isao Hayase, both of Tsuchiura; Kenichi Oshima, Tochigi-ken, all of Japan

[73] Assignee: Hitachi, Ltd., Tokyo, Japan

[21] Appl. No.: 08/766,468

[22] Filed: Dec. 12, 1996

[30] Foreign Application Priority Data

Dec. 13, 1995 [JP] Japan ..... 7-324322

[51] Int. Cl.[6] ..... F01C 1/04

[52] U.S. Cl. ..... 418/55.2

[58] Field of Search ..... 418/55.2

[56] References Cited

U.S. PATENT DOCUMENTS

| | | | |
|---|---|---|---|
| 4,303,379 | 12/1981 | Hiraga et al. | 418/55.2 |
| 4,527,964 | 7/1985 | Mitsui et al. | 418/55.2 |
| 5,624,247 | 4/1997 | Nakamura | 418/55.2 |

FOREIGN PATENT DOCUMENTS

| | | | |
|---|---|---|---|
| 57-186085 | 11/1982 | Japan | 418/55.2 |
| 59-23095 | 2/1984 | Japan | 418/55.2 |
| 64-63680 | 3/1989 | Japan | 418/55.2 |
| 1-273891 | 11/1989 | Japan | 418/55.2 |
| 6-213176 | 8/1994 | Japan . | |

*Primary Examiner*—John J. Vrablik

*Attorney, Agent, or Firm*—Antonelli, Terry, Stout & Kraus, LLP

[57] ABSTRACT

The present invention enables a scroll fluid machine to have a maximum design volume ratio without increasing an outside dimension of scrolls and allows the basic spiral curve of the scroll to be configured with simple curves. The basic spiral curve of a scroll wrap comprises a group of concentric semicircles, a group of circular arcs having a center different from that of the group of semicircles, and a group of straight lines or curves connecting the group of semicircles and the group of circular arcs together, and a diameter of the outer-most circumferential semicircle of a fixed scroll member is twice as large as radius of the outer-most circumferential circular arc of an orbiting scroll member. In addition, an outer diameter of an end plate of an orbiting scroll is equal to an outer diameter of the outer-most circumferential wrap of the scroll.

19 Claims, 16 Drawing Sheets

SCROLL TYPE FLUID MACHINE HAVING WRAPS FORMED OF CIRCULAR ARCS

BACKGROUND OF THE INVENTION

The present invention relates to a scroll type fluid machine that is one type of a positive displacement fluid machine, and in particular, to a scroll fluid machine in which a scroll wrap is formed of circular arcs and straight lines.

Conventional scroll type fluid machines comprise a fixed scroll and an orbiting scroll eccentrically combined with each other and having a wrap of the same shape and as the wrap form, an involute curve is used typically. If an involute curve is used, the wrap pitch is constant and, therefore, the volume change rate is also constant. Thus, if an attempt is made to increase the internal volume ratio (design volume ratio) that is the ratio of the outer-most circumferential sealed volume (stroke volume) to the inner-most circumferential sealed volume within a predetermined dimension, when the number of turns of the wrap is increased, the wrap pitch is reduced, resulting in the reduction of the orbiting radius and thus the stroke volume. As a result, it is not possible to increase the internal volume ratio significantly.

In addition, since the fixed and the orbiting scrolls are eccentrically combined with each other, an unused space exists in the outer circumferential portion, and an attempt to reduce the size of the fluid machine may result in various problems due to the stroke volume and the design volume ratio. In particular, in scroll type fluid machines of a shaft penetration type in which a main shaft for revolving the orbiting scroll penetrates through the center of the orbiting and the fixed scrolls, the inner-most circumferential sealed volume (the volume of a compression space at the initiation of discharge) is reduced an amount of the space through which the main shaft penetrates, and an attempt to reduce the size of the fluid machine may result in various problems due to the stroke volume and the design volume ratio.

With respect to the above problems, one of the known techniques, in which an outer curve of the scroll wrap is circular while an inner curve thereof is involute with a high order curve extending between the outer and the inner curve, is described in Japanese Patent Unexamined Publication No. 6-213176.

In the above conventional technique, it is not easy to work the wrap. In addition, this conventional technique has critical values for the external shape and the design volume ratio. If, for example, this conventional technique is applied to a scroll type fluid machine of a shaft penetration type, the wrap must first be wound from an outside of the main shaft due to the main shaft being at the center of the wrap. The volume of a minimum confined space formed by the wrap involute or other curves becomes larger as this space is located closer to the outer-most circumference, so the provision of a constant design volume ratio (the ratio of the volume of the compression space at the initiation of compression to the same volume at the initiation of discharge) requires an increase in the number of the turns of the wrap outwardly, thereby increasing the outside dimension of the scroll. The outside dimension of the compressor is further increased by a rotation preventing mechanism section formed at the outer circumference of an end plate disposed further outwardly of the end of the turns of the wrap for preventing the rotation of the orbiting scroll. Thus, this conventional technique cannot provide refrigerating and air-conditioning scroll compressors with a diameter of 160 mm or less at a required rated power in the order of 5 horsepower, domestic air-conditioning scroll compressors with a diameter of 110 mm or less at a required rated power in the order of 1,800 watt, or scroll compressors for domestic refrigerators with a diameter of 90 mm or less at a required rated power in the order of 240 watt.

SUMMARY OF THE INVENTION

A first object of this invention is to provide a scroll type fluid machine with its outside dimension reduced by making the best use of the space around the outer circumference of a scroll.

A second object of this invention is to simplify the basic spiral curve of a scroll wrap.

A third object of this invention is to provide a scroll type fluid machine that can have a large design volume ratio without increasing the outside dimension of the scroll.

A fourth object of this invention is to provide a scroll type fluid machine that can reduce the variation of torque associated with compression.

The above objects can be achieved by providing a scroll type fluid machine in which two scroll members each formed of an end plate and a wrap stood upright thereto are engaged with each other in a condition that the wraps face inwardly, and in which one of the scroll members orbits around the other scroll member at a predetermined orbiting radius while not apparently rotating around its axis, wherein half of a basic spiral curve of the wrap of both scrolls is formed of concentric circular arcs while the other half is formed of a plurality of circular arcs the centers of which are offset from the center of the concentric circular arcs. The basic spiral curve of the wrap of one of the scrolls may be constituted by repeatedly connecting a plurality of circular arcs of different radii in the descending order of the size of the radius, while the basic spiral curve of the wrap of the other scroll may be formed of one of the two envelopes drawn when the basic spiral curve of the first wrap is circularly moved at the above orbiting radius. Alternatively, straight lines may be inserted among the plurality of circular arcs connected in the descending order of the size of the radius. The outer-most circumferential circular arc is desirably a semicircle.

The above objects can also be achieved by providing a scroll type fluid machine in which two scroll members each formed of an end plate and a wrap stood upright thereto are engaged with each other in a condition that the wraps face inwardly, and in which one of the scroll members orbits around the other scroll member at a predetermined orbiting radius while not apparently rotating around its axis, wherein the basic spiral curve of the wrap of both scrolls is formed of a group of concentric semicircles, a group of circular arcs having a center different from that of the group of semicircles, and a group of straight lines or curves connecting the group of semicircles and the group of circular arcs together. The wrap of one of the scrolls may be formed of a group of concentric semicircles, a group of circular arcs having a center different from that of the group of semicircles, and a group of straight lines or curves connecting the group of semicircles and the group of circular arcs together, while the curve of the wrap of the other scroll may be formed of one of the two envelopes drawn when the wrap of the first scroll is circularly moved at the above orbiting radius.

Each of the above means can also be applied to scroll type fluid machines in which an orbiting scroll with a wrap provided on both surfaces of a plate and fixed scrolls are eccentrically combined with each other with the wraps facing each other and in which a drive shaft penetrating through the orbiting and the fixed scrolls causes the orbiting scroll to orbit around the fixed scroll at a predetermined orbiting radius while not apparently rotating around its axis.

By forming the outer-most circumference of the scroll wrap mainly of a circular arc and aligning the diameter of the circular arc with the diameter of the end plate with the scroll wrap stood upright thereto, the dead space that is located outside the scroll wrap and which is not involved in the suction and compression operations can be reduced and the scroll wrap can be machined easily.

BRIEF DESCRIPTION OF THE DRAWINGS

FIG. 3 is a view in which FIG. 2 is overlapped over FIG. 1;

FIG. 7 is a view in which FIG. 5 is overlapped over FIG. 6;

DESCRIPTION OF THE PREFERRED EMBODIMENTS

In the following description of the embodiments, terms "semicircles", "circles", and "circular arcs" are used. These terms include not only those semicircles, circles, and circular arcs which can be designed but also those which are out of design specifications after manufacturing as long as their errors are within a range that does not prevent the scroll type fluid machine from operating correctly. The embodiments actually refer to designed semicircles, circles, and circular arcs.

Several embodiments according to this invention are described with reference to the drawings.

Figure 1:
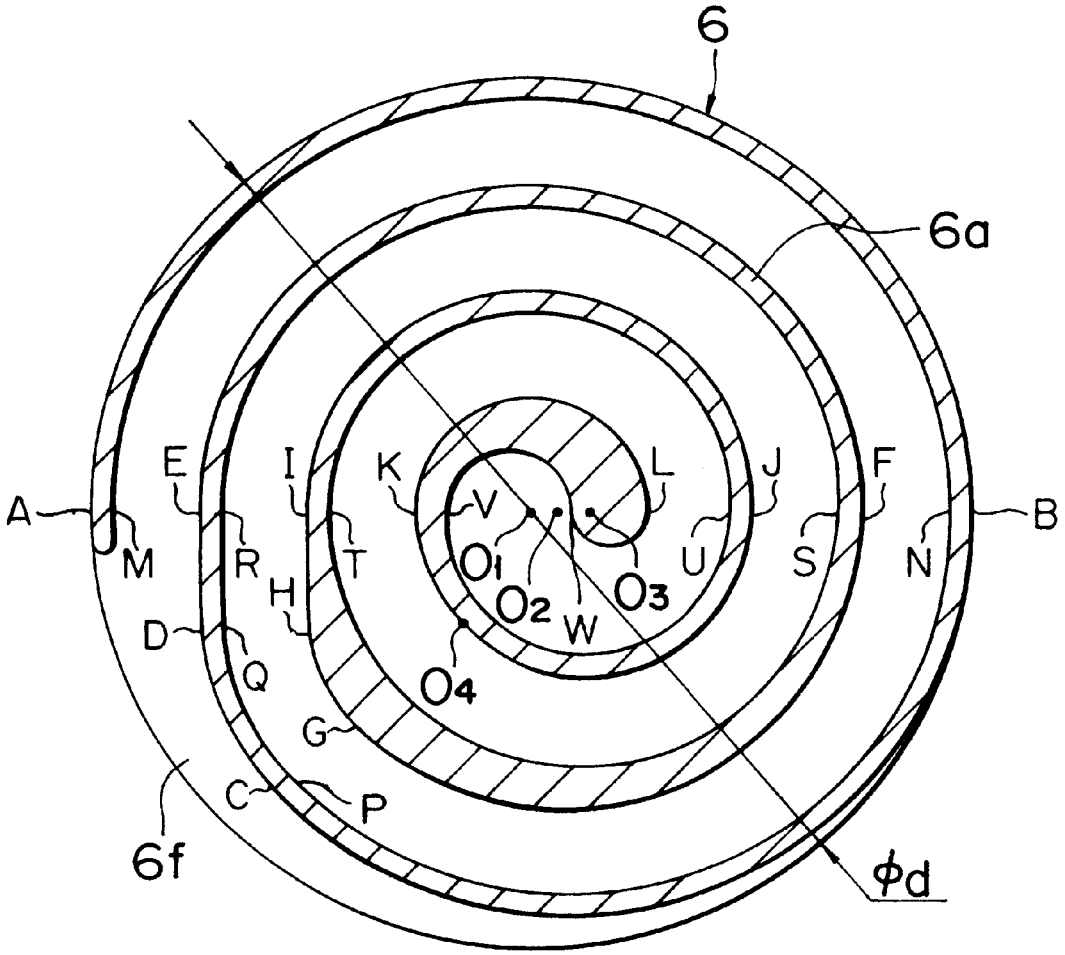
FIG. 1 is a cross sectional view of an orbiting scroll according to a first embodiment of this invention.
Figure 2:
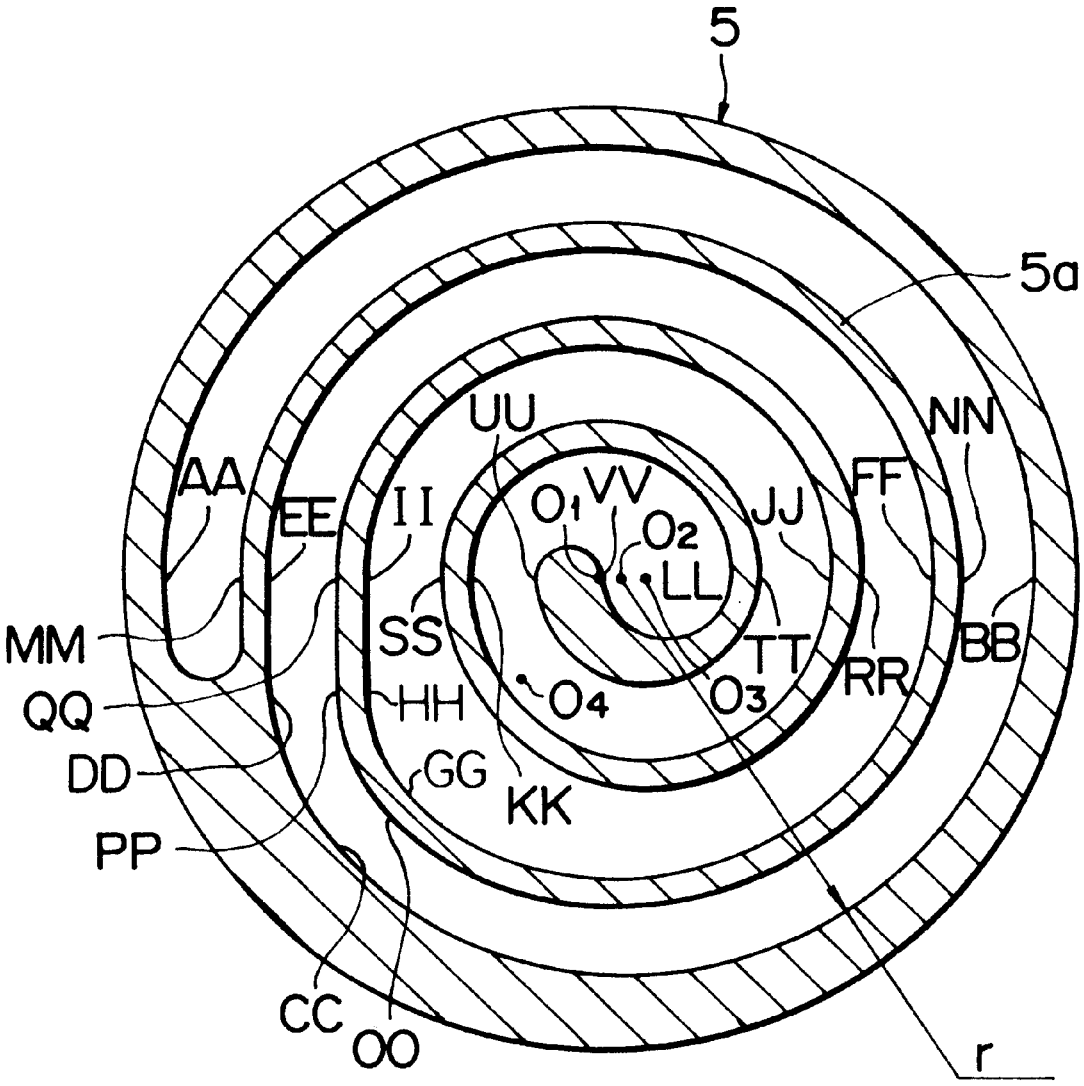
FIG. 2 is a cross sectional view of a fixed scroll according to the first embodiment of this invention.
Figure 3:
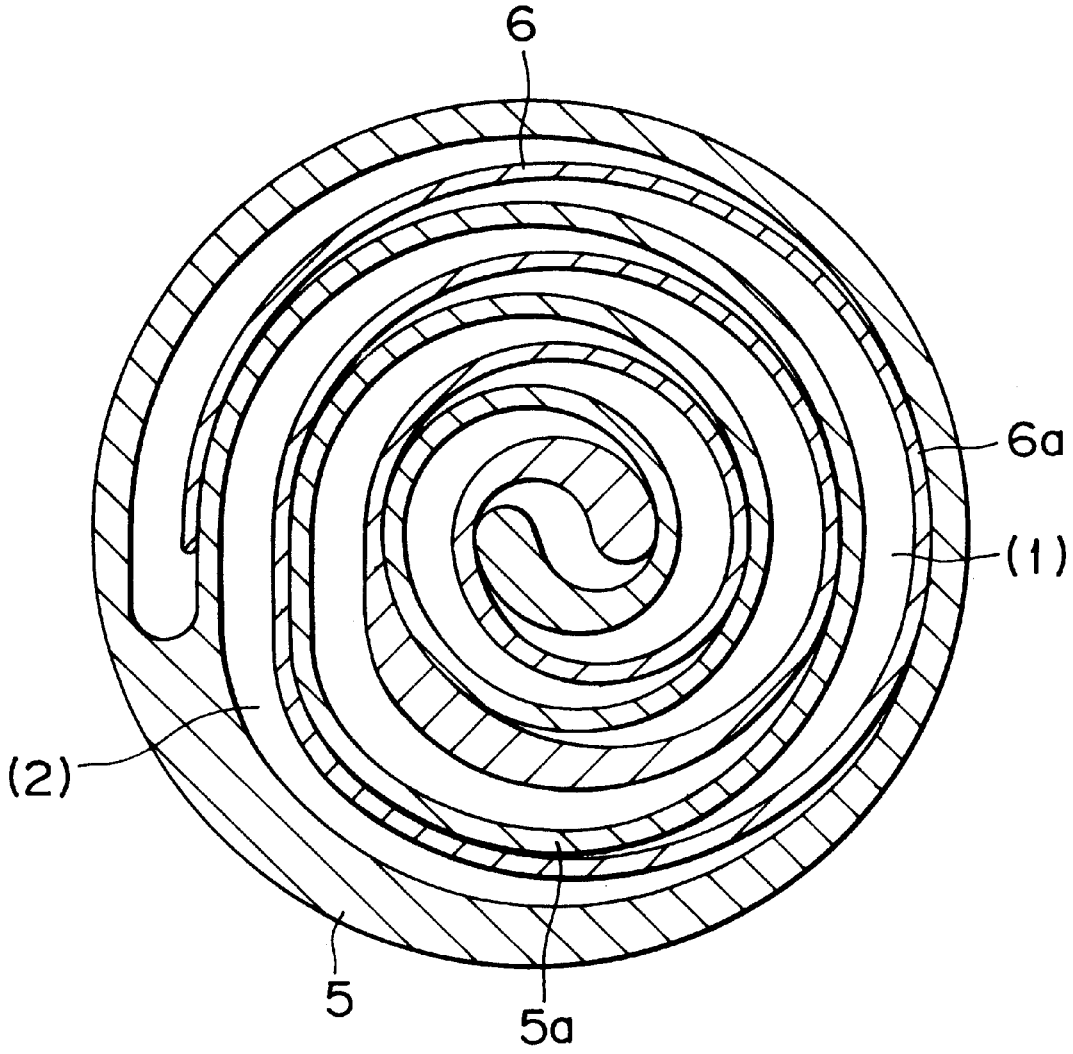

A first embodiment of this invention is first described with reference to FIGS. 1 to 3. FIG. 1 is a cross sectional view of an orbiting scroll in a scroll type fluid machine according to this first embodiment showing the shape of the scroll. FIG. 2 is a cross sectional view of a fixed scroll in the scroll type fluid machine according to this embodiment showing the shape of the scroll. FIG. 3 is a view in which FIG. 2 is overlapped over FIG. 1.

Referring to FIG. 1, a method for forming a wrap 6*a* in an orbiting scroll 6 is described.

In an upper side relative to a line A-$O_1$-B, a group of semicircles A-B, E-F, I-J, K-L, M-N, R-S, and T-U are formed so as to be centered at a point $O_1$. The semicircles M-N and R-S are centered at the point $O_1$ and have a smaller radius than the semicircles A-B and E-F by a wrap thickness $t_1$. The semicircle T-U is centered at the point $O_1$ and has a smaller radius than the semicircle I-J by a wrap thickness $t_2$. In a lower side relative to the line A-$O_1$-B, a group of circular arcs B-C, F-G, and N-P are formed so as to be centered at a point $O_2$ and a group of circular arcs S-T, J-K, and U-V are formed so as to be centered at a point $O_3$ in such a way that these circular arcs smoothly connect to the group of semicircles described above. Furthermore, a group of circular arcs C-D, G-H, and P-Q centered at a point $O_4$ are formed so as to smoothly connect to the group of circular arcs B-C, F-G, and N-P, respectively, and straight lines D-E, H-I, and Q-R are formed so as to smoothly connect to the circular arcs C-D, G-H, and P-H, respectively. The center of the wrap is formed so as to allow circular arcs L-W and V-W to smoothly connect to each other. The wrap configured in this manner is upright to an end plate 6*f* in such a way that the distance between wraps (wrap groove width) is maintained at a value. The outer-most circumferential circular arc of the orbiting scroll wrap is formed as a semicircle, and the outer diameter of the end plate 6*f* of the orbiting scroll 6 is twice as large as the radius of this semicircle.

As is seen in FIG. 1, the wrap 6*a* formed upright to the end plate 6*f* is formed in such a manner that there is virtually no useless space between the outer-most circumferential wrap and a circle circumscribing the wrap at the outer circumferential end.

Likewise, a method for forming a wrap 5*a* in a fixed scroll 5 is described with reference to FIG. 2. In the upper side relative to a line AA-$O_1$-BB, a group of semicircles AA-BB, EE-FF, II-JJ, KK-LL, MM-NN, QQ-RR, and SS-TT are formed so as to be centered at a point $O_1$. When the thickness of the wrap of the orbiting scroll is referred to as $t_1$ and an orbiting radius is referred to as $\epsilon$, the semicircles MM-NN and QQ-RR are centered at the point $O_1$ and have a smaller radius than the semicircles AA-BB and EE-FF by $t_1+2\epsilon$ (this distance is the wrap groove width of the fixed scroll). When the thickness of the wrap of the orbiting scroll is referred to as $t_2$, the semicircle SS-TT is centered at the point $O_1$ and has a smaller radius than the semicircles II-JJ by $t_2+2\epsilon$ (this distance is the wrap groove width of the fixed scroll). In the lower side relative to the line AA-$O_1$-BB, a group of circular arcs BB-CC, FF-GG, and NN-OO are formed so as to be centered at a point $O_2$ and a group of circular arcs RR-SS, JJ-KK, and TT-UU are formed so as to be centered at a point $O_3$ in such a way that these circular arcs smoothly connect to the group of semicircles described above. Furthermore, a group of circular arcs CC-DD, GG-HH, and OO-PP centered at a point $O_4$ are formed so as to smoothly connect to the group of circular arcs BB-CC, FF-GG, and NN-OO, respectively, and straight lines DD-EE, HH-II, and PP-QQ are formed so as to smoothly connect to the circular arcs CC-DD, GG-HH, and OO-PP, respectively. The center of the wrap is formed so as to allow circular arcs LL-VV and UU-VV to smoothly connect to each other.

As described above, since the end plate 6*f* of the orbiting scroll 6 comprises a disc with a diameter that is twice as large as the radius of the semicircle constituting the outer-most circumferential wrap of the orbiting scroll 6, a portion of the end plate which is located outside the wrap 6*a,* that is, a portion that is located between the orbiting and the fixed scrolls and which is not involved in the suction and compression operations becomes smaller.

When, in the fixed scroll 5, the radius of the outer-most circumferential circular arc of the group of circular arcs centered at the point $O_2$, that is, the circular arc BB-CC is referred to as (r) and when, in the orbiting scroll 6, the diameter of the outer-most circumferential semicircle of the group of semicircles centered at the point $O_1$, that is, the semicircle A-B is referred to as (d), the diameter is determined so as to be d=2 r. This setting can minimize the outer dimension of the orbiting scroll 6, in other words, the outer dimension of the fluid machine when the orbiting scroll 6 is combined with the fixed scroll 5.

The radii of the circular arcs A-B, B-C, and C-D, become smaller in this order. The central angles of the circular arcs B-C, F-G, and N-P are located between 90° and 135°, and the central angles of the circular arcs C-D, G-H, and P-Q and the straight lines D-E, H-I, and Q-R are located between 90° and 45° around the point $O_4$. Similarly, the central angles of the circular arcs BB-CC, FF-GG, and NN-OO are located between 90° and 135°, and the central angles of the circular arcs CC-DD, GG-HH, and OO-PP and the straight lines DD-EE, HH-II, and PP-QQ are located between 90° and 45° around the point $O_4$.

FIG. 3 is a view in which FIG. 2 is overlapped over FIG. 1. In this drawing, both an actuating space (1) formed by the inner curve of the wrap 6*a* of the orbiting scroll 6 and the outer curve of the wrap 5*a* of the fixed scroll 5 and an actuating space (2) formed by the inner curve of the wrap 5*a* of the fixed scroll 5 and the outer curve of the wrap 6*a* of the orbiting scroll 6 have the maximum volume, that is, the suction operation has been finished. As seen in FIG. 1, there is virtually no useless space around the orbiting scroll 6 and accordingly, as seen in FIG. 3, the space between the outer circumference of the orbiting scroll 6 and the inner circumferential surface of the outer circumferential wall of the fixed scroll is sufficiently effectively used for the suction and compression operations. Thus, there is virtually no useless space in these scrolls. That is, the inside of the fixed scroll 5 is effectively used, and the volume can be maximized if the outer diameter is specified, while the outer diameter can be minimized if the volume is specified.

Although according to this embodiment, the outer-most diameter of the end plate 6*f* of the orbiting scroll 6 is the same as the diameter of the semicircle A-B that is the outer-most circumferential semicircle of the group of semicircles centered at the point $O_1$, this invention is not limited to this aspect but is applicable to not only general orbiting scrolls but also those in which the outer-most diameter of the end plate 6*f* is larger than the maximum diameter of the wrap.

Figure 4:
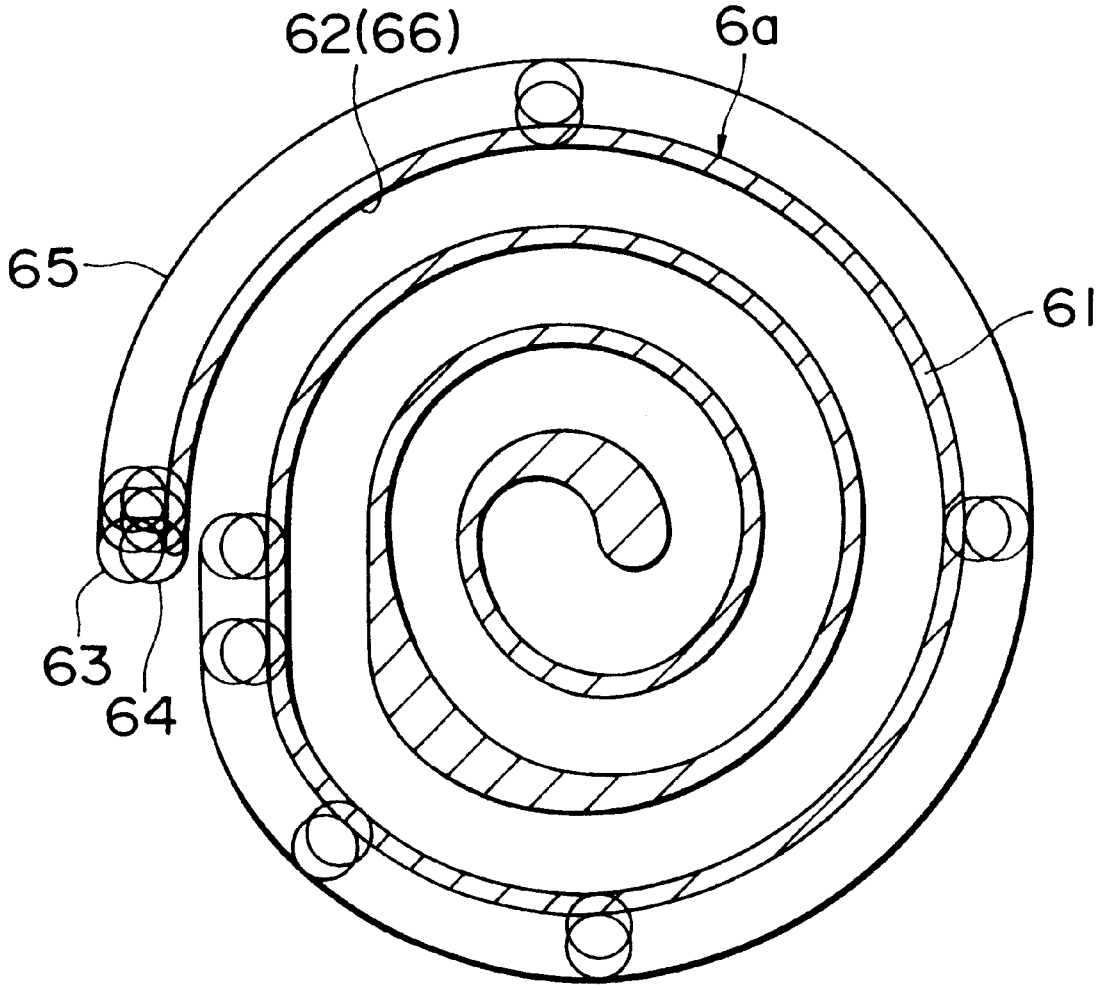
FIG. 4 is a view for describing a method for forming the shape of the scroll according to a second embodiment of this invention.
Figure 5:
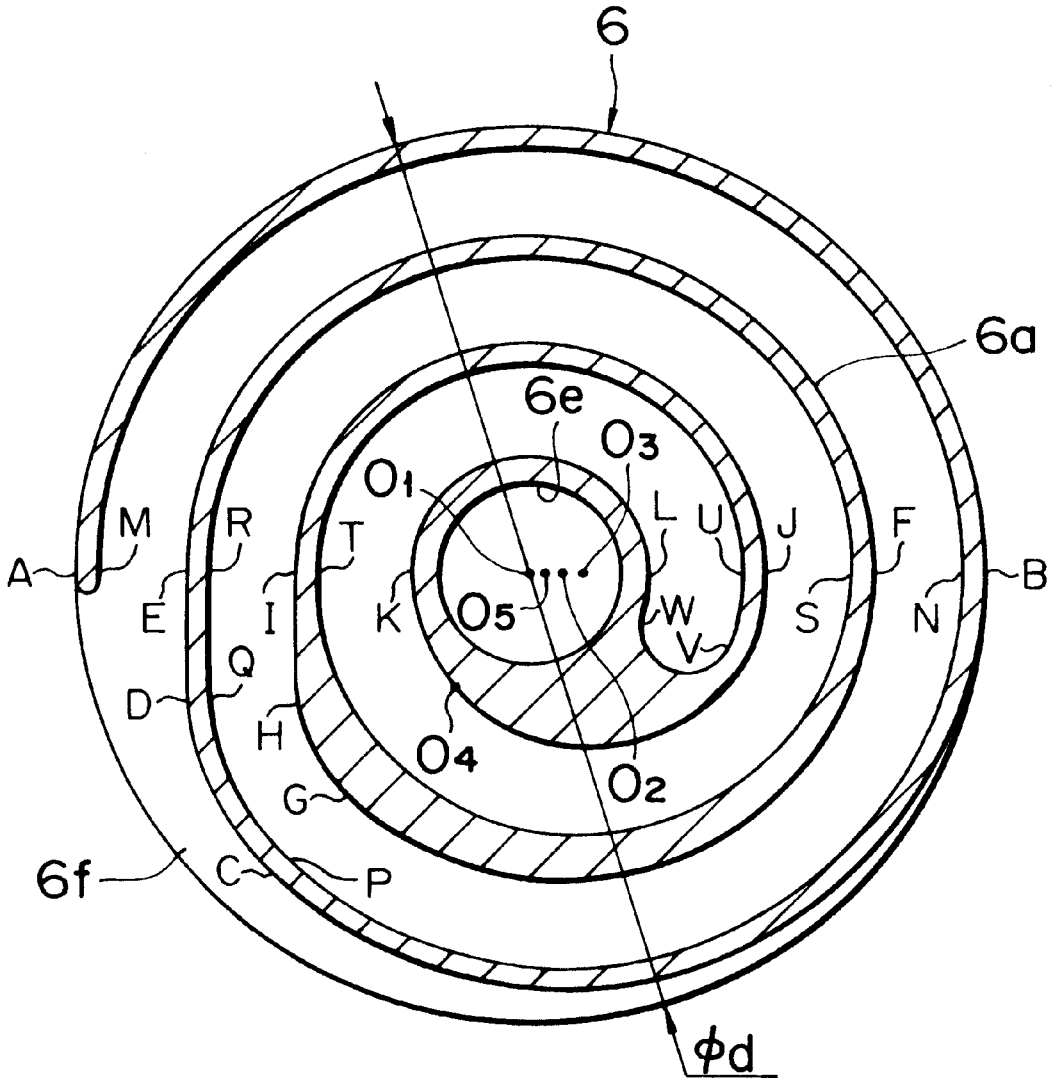
FIG. 5 is a cross sectional view of an orbiting scroll according to a third embodiment of this invention.
Figure 6:
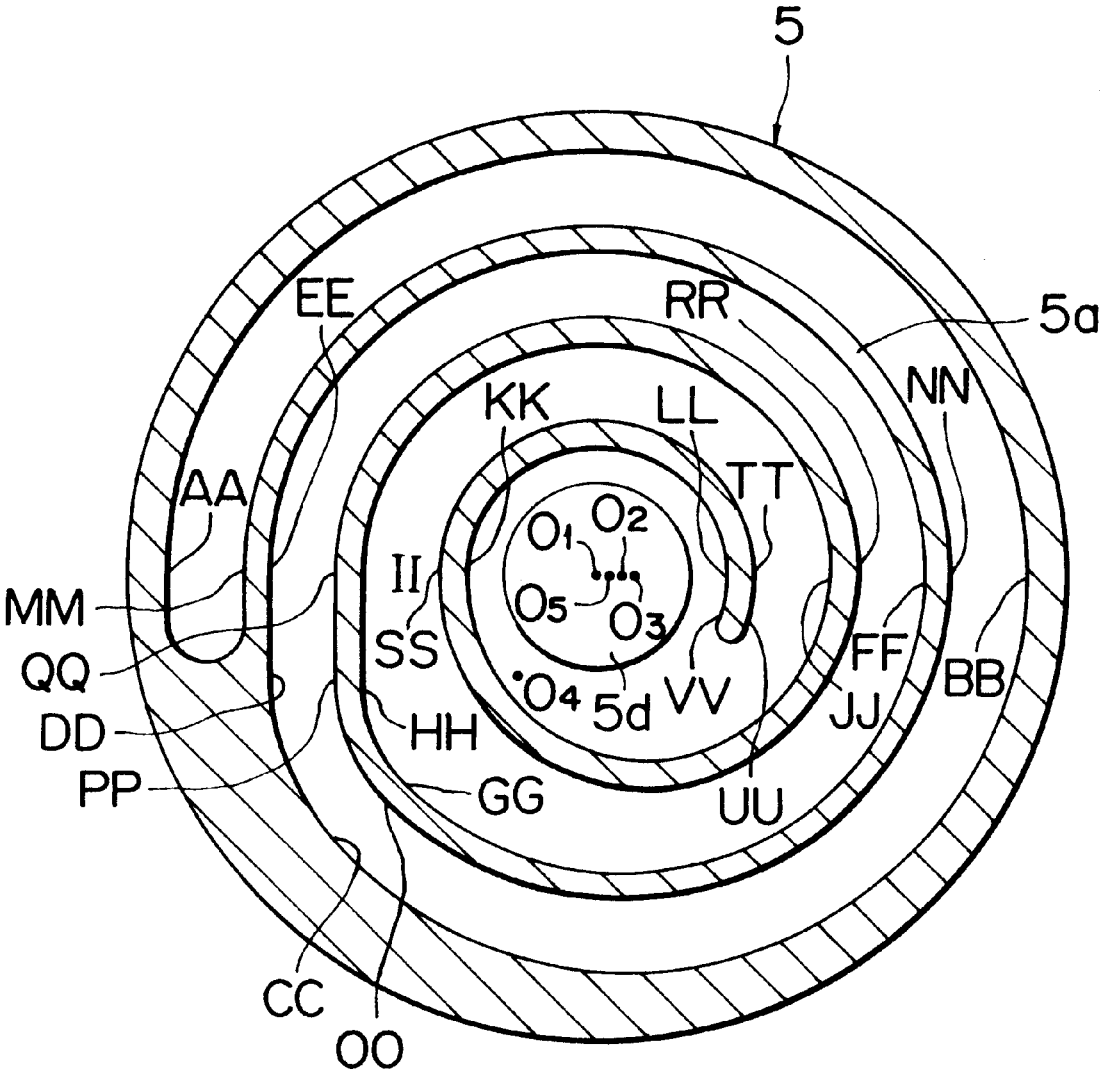
FIG. 6 is a cross sectional view of a fixed scroll according to the third embodiment of this invention.

A second embodiment of this invention is described with reference to FIG. 4. FIG. 4 is a view describing another method for forming a scroll wrap. In FIG. 4, part of the envelope is omitted so as to avoid the complexity of illustration. As described in the first embodiment, the basic spiral curve of the wrap 6*a* of the orbiting scroll 6 is created. This basic spiral curves includes an outer curve 61 and an inner curve 62 of the wrap 6*a*, and provides envelopes 65 and 66 of circular locuses drawn when the curves 61 and 62 are circularly moved at the orbiting radius $\epsilon$. The envelope 65 constitutes the inner curve of the wrap 5*a* of the fixed scroll 5, while the envelope 66 constitutes the outer curve of the wrap 5*a*. Although in FIG. 4, the envelopes of circular locuses drawn when the basic spiral curve of the wrap 6*a* of the orbiting scroll 6 is circularly moved at the orbiting radius $\epsilon$ have been determined, the envelopes of circular locuses drawn when the basic spiral curve of the wrap 5*a* of the fixed scroll 5 is circularly moved at the orbiting radius $\epsilon$ may be determined.

Next, a third embodiment of this invention is described with reference to FIGS. 5 to 8. The same components as in the above embodiments have the same reference numerals, and their description is omitted.

This embodiment provides a scroll shape that can be preferably applied to scroll type fluid machines of a shaft penetration type in which a main shaft for orbiting the orbiting scrolls 6 penetrates through the orbiting and the fixed scrolls. The inner-most circumferential sealed volume is an important space as the volume of compression space at the initiation of discharge, but in this type, this volume is reduced by the space through which the main shaft penetrates. This causes the design volume ratio to be smaller than the design point. To approach a design volume ratio to the design point, the outer-most circumferential sealed volume (the volume of the compression space at the end of the suction operation) must be increased, which requires an increase in the outside dimension of the scrolls and the number of the turns of the wrap. This method, however, causes the size of the fluid machine to be increased. It is the greatest technical object for scroll type fluid machines of a shaft penetration type to provide a design volume ratio that is closer to the design point without increasing the outside dimension.

Figure 7:
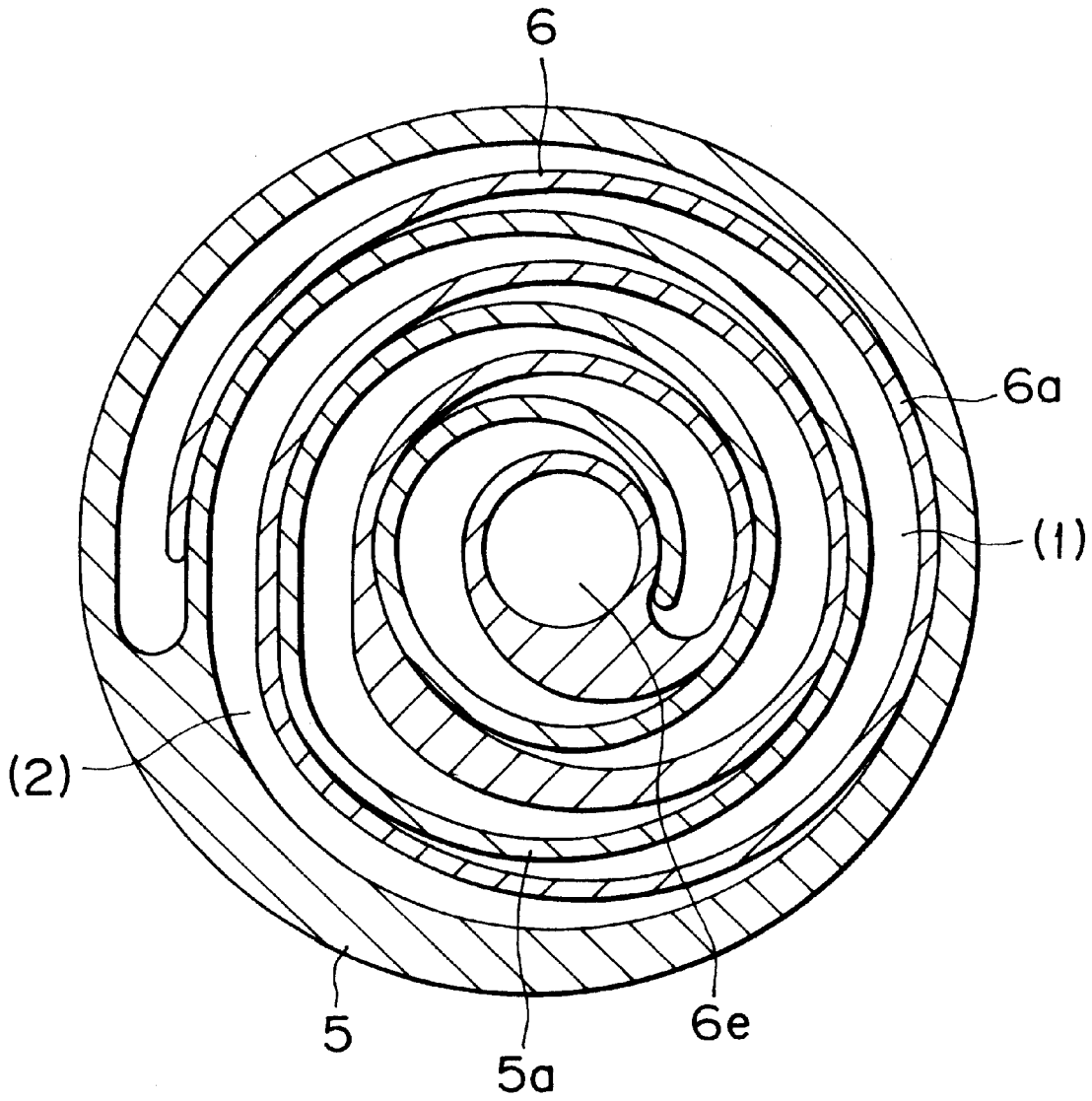

Holes 6*e* and 5*d* through which a main shaft penetrates are provided in the center of the orbiting and the fixed scrolls 6 and 5. In particular, the hole 6*e* acts as a housing for supporting an orbiting bearing, requiring a sufficient strength. The circular arcs L-W and U-V centered at a point $O_5$ are formed in the center of the orbiting scroll 6 so as to smoothly connect to the semicircles K-L and T-U centered at the point $O_1$, with the circular arc V-W formed so as to close the wrap groove. On the other hand, the circular arcs LL-VV and TT-UU centered at a point $O_5$ are formed in the center of the fixed scroll 5 so as to smoothly connect to the semicircles KK-LL and SS-TT centered at the point $O_1$, with the circular arc UU-VV formed so as to close the wrap. As shown in FIG. 7, the circular arcs V-W and UU-VV seal the wrap.

Figure 8A:
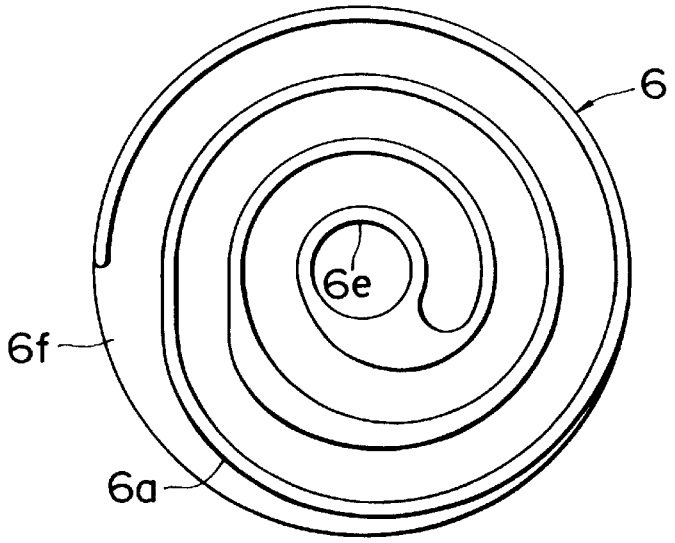
FIGS. 8(*a*) and 8(*b*) are views showing a comparison of the size of the orbiting scroll according to the embodiment of this invention to the size of an orbiting scroll according to conventional techniques.
Figure 8B:
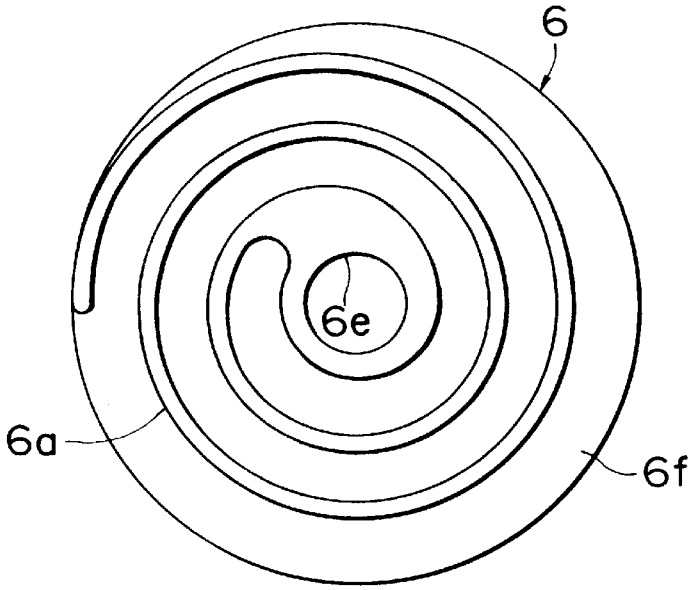
FIG. 8(b) PRIOR ART

FIG. 8 shows a comparison of the size of the wrap and the effective use of the space between the case in which the orbiting scroll 6 is configured using the composite curves according to this invention (FIG. 8(*a*)) and the case in which the orbiting scroll 6 is configured using conventional involute curves (FIG. 8(*b*)), under the condition that the diameter of the throughhole 6*e* in the center and the height of the wrap are the same and that the stroke volume is constant. Comparing FIG. 8(*a*) and FIG. 8(*b*), it is appreciated that by constituting the orbiting scroll using the composite curves according to this invention, the outside dimension of the scroll can be significantly reduced than the orbiting scroll constituted using conventional involute curves. In particular, it is appreciated that the space corresponding to three-fourths of the outer circumferential section of the wrap is effectively used.

Figure 9:
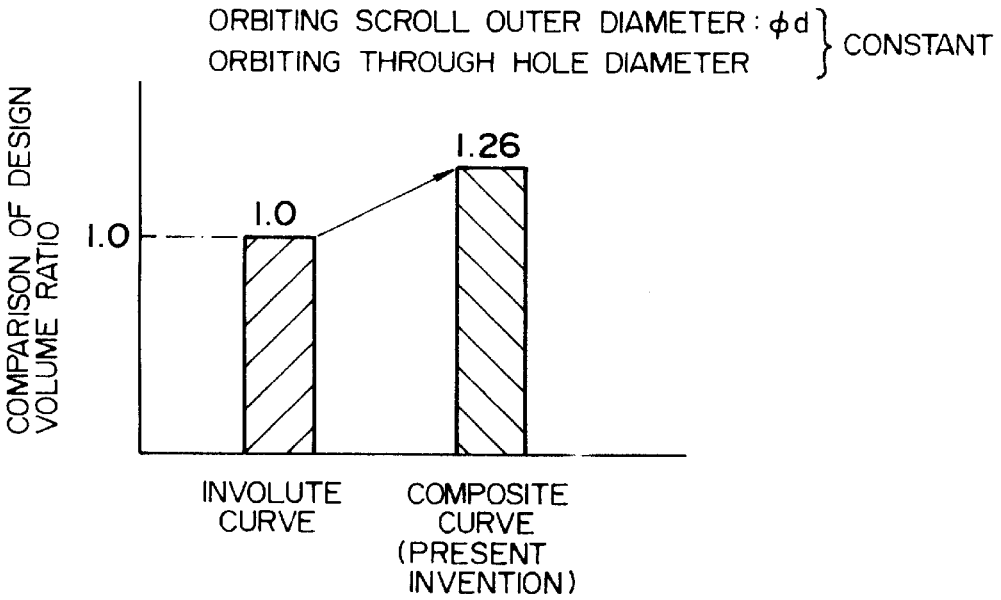
FIG. 9 is a view showing comparison of the design volume ratio according to the embodiment of this invention to the design volume ratio according to conventional techniques.

Next, this invention is quantitatively evaluated. FIG. 9 shows a comparison of the design volume ratio between the case in which the composite curves according to this invention are used and the case in which conventional involute curves are used, under the condition that the height of the wrap is the same, that the stroke volume, the outer dimension of the orbiting scroll, and the diameter of the throughhole are fixed, and that the ratio is expressed by setting the design volume ratio for the conventional involute curves as 1.0. The application of this invention can increase the design volume ratio by 26% in comparison with the use of conventional involute curves. In other words, this invention can increase the stroke volume by 26% in comparison with the use of conventional involute curves. Japanese Patent Unexamined Publication No. 6-213176 described above, which is a conventional technique, states that the "invention can increase the amount by up to 15% with the same envelope" in comparison with the use of involute curves. Although the comparison condition used in this specification is unknown, if it is assumed to be the same as in the present embodiment, the present invention can further increase the stroke volume than this conventional technique.

Figure 10:
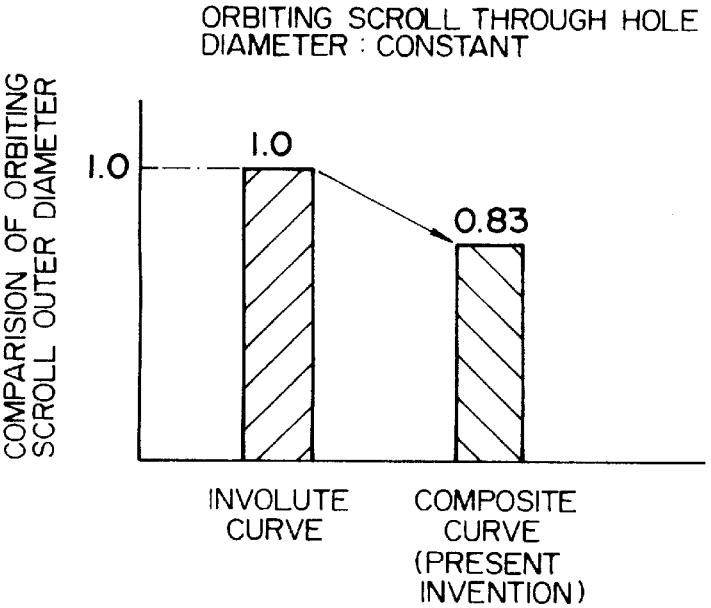
FIG. 10 is a view showing comparison of the outer diameter of the orbiting scroll according to the embodiment of this invention to the outer diameter of an orbiting scroll according to conventional techniques.

FIG. 10 shows a comparison of the outer diameter of the orbiting scroll between the case in which the composite curves according to this invention are used and the case in which conventional involute curves are used, under the condition that the height of the wrap is the same, that the stroke volume, the diameter of the throughhole of the orbiting scroll, and the design volume ratio are fixed, and that the ratio is expressed by setting the outer diameter of the orbiting scroll with the conventional involute curves as 1.0. The application of this invention has reduced the outer diameter of the orbiting scroll by 17% in comparison with the use of conventional involute curves.

The above embodiments form the basic spiral curve of the wrap of the orbiting scroll with the thickness of the wrap of the fixed scroll set at a fixed value, so the thickness of the wrap of the orbiting scroll is non-uniform. However, the orbiting scroll can be formed using a basic spiral curve with the thickness of the wrap of the orbiting scroll set at a fixed value.

Figure 11:
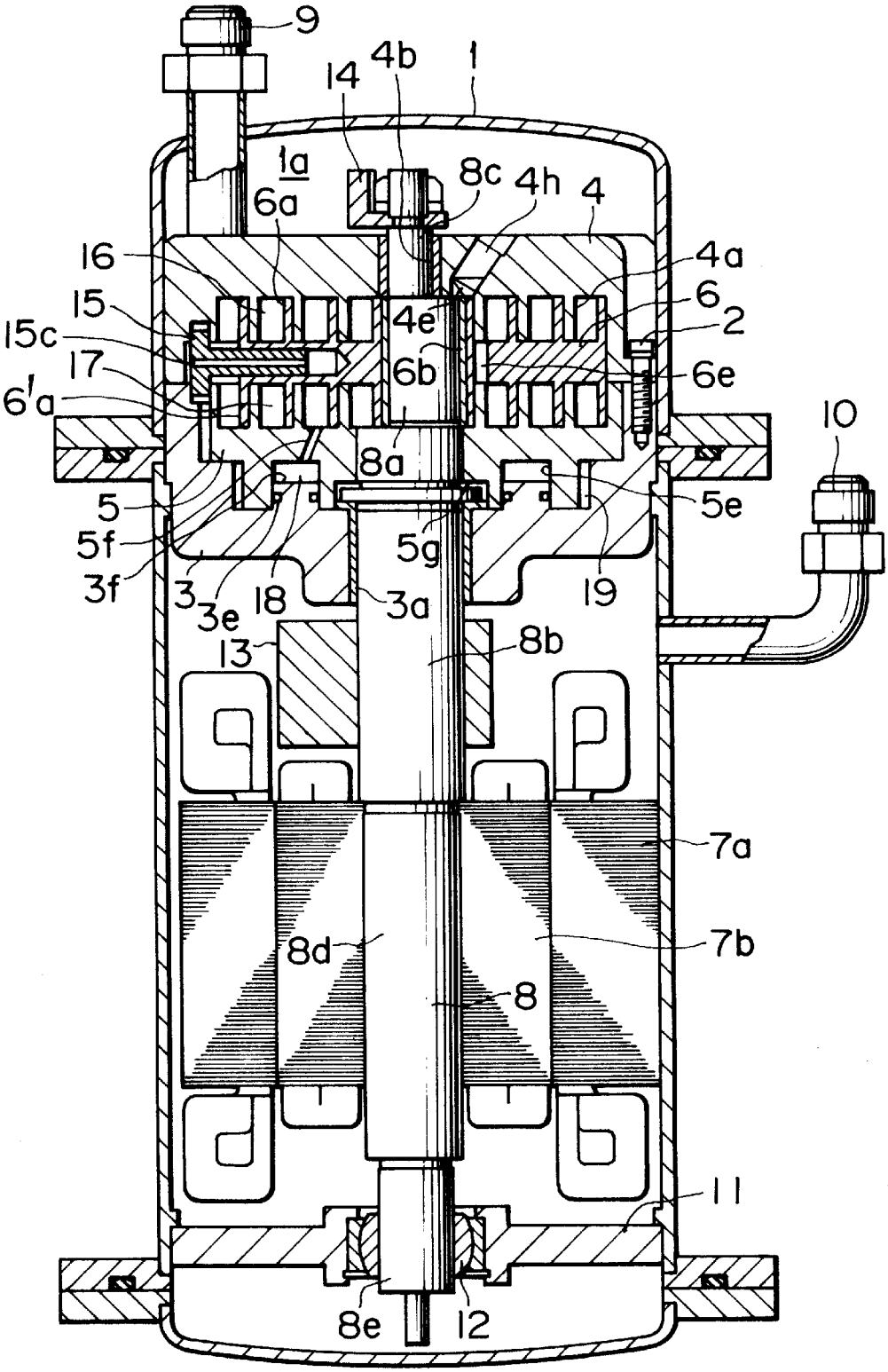
FIG. 11 is a view showing the overall structure of a fourth embodiment in which this invention is applied to a refrigerating and air-conditioning scroll compressor.
Figure 12:
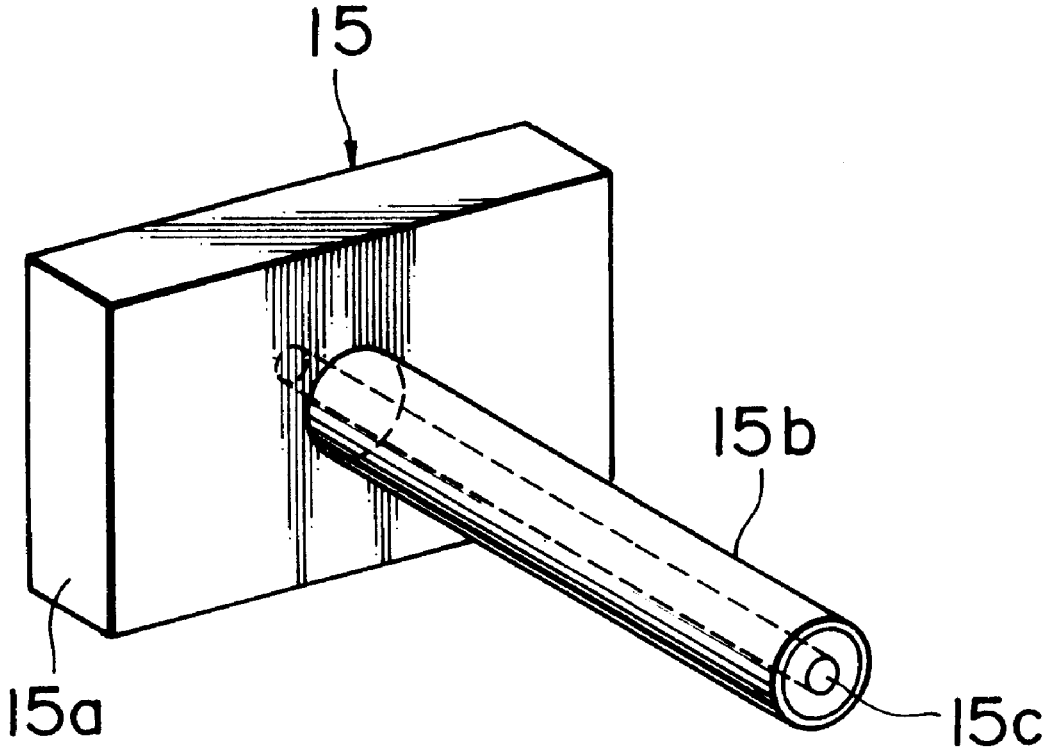
FIG. 12 is a perspective view of an Oldham's coupling in the fourth embodiment.
Figure 13:
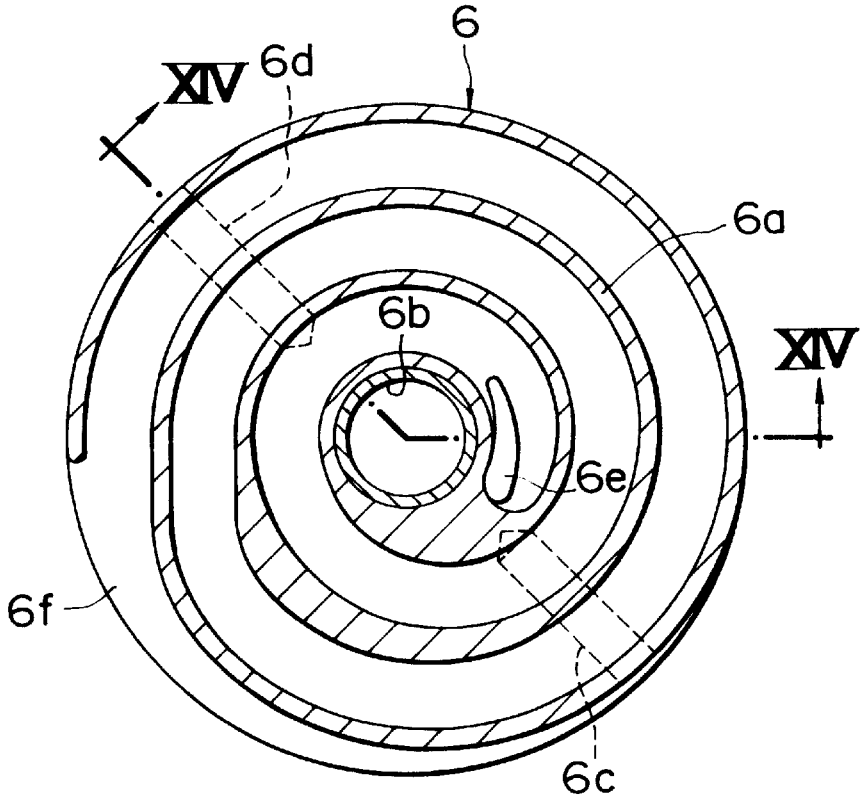
FIG. 13 is a cross sectional view of an orbiting scroll in the fourth embodiment of this invention.
Figure 14:
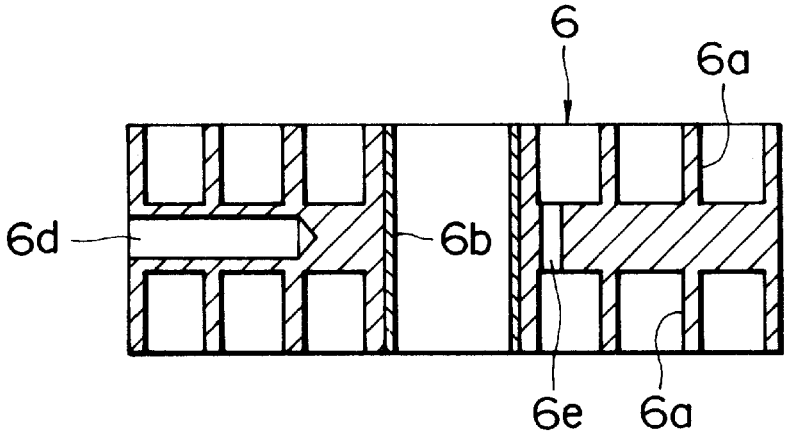
FIG. 14 is a cross sectional view taken along line XIV—XIV in FIG. 13.
Figure 15:
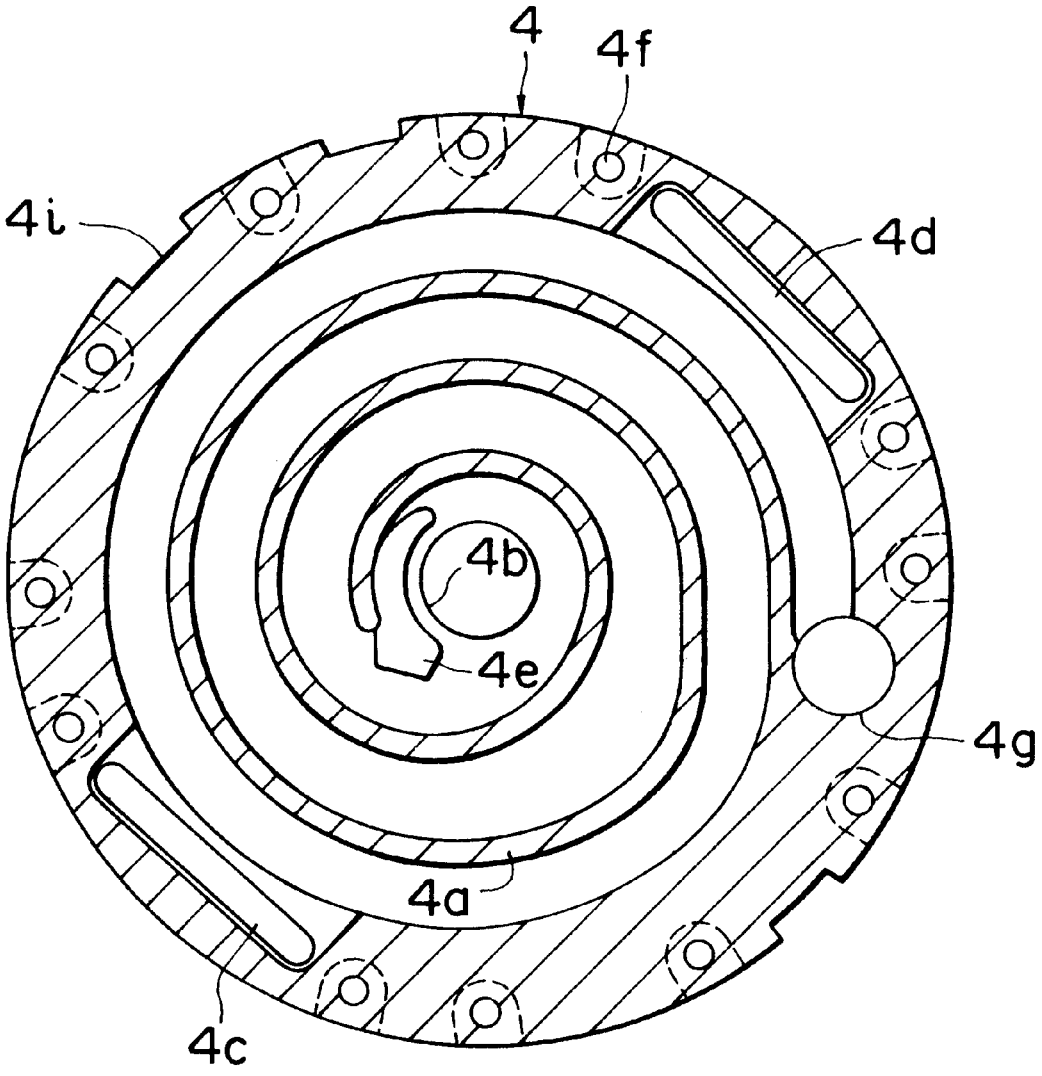
FIG. 15 is a cross sectional view of a first fixed scroll in the fourth embodiment of this invention.
Figure 16:
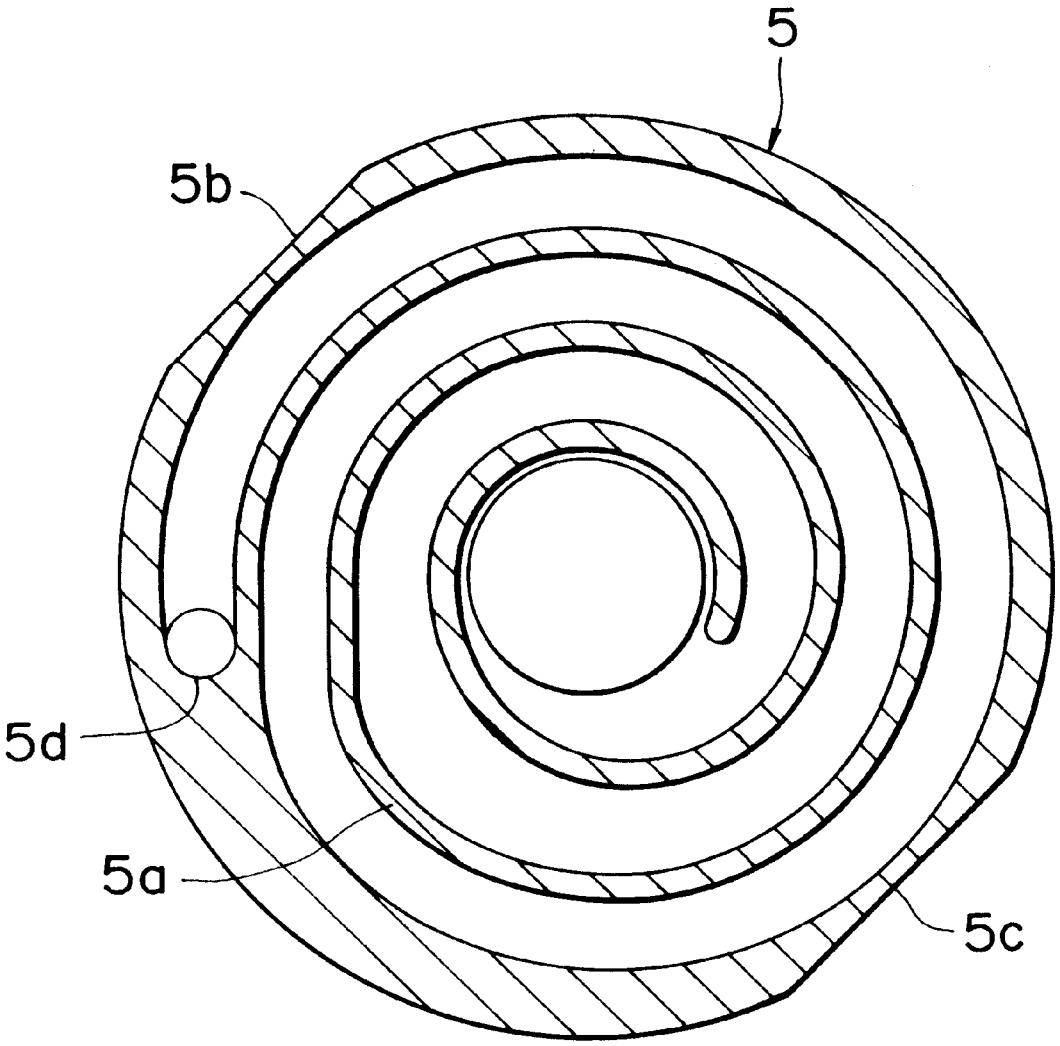
FIG. 16 is a cross sectional view of a second fixed scroll in the fourth embodiment of this invention.
Figure 17:
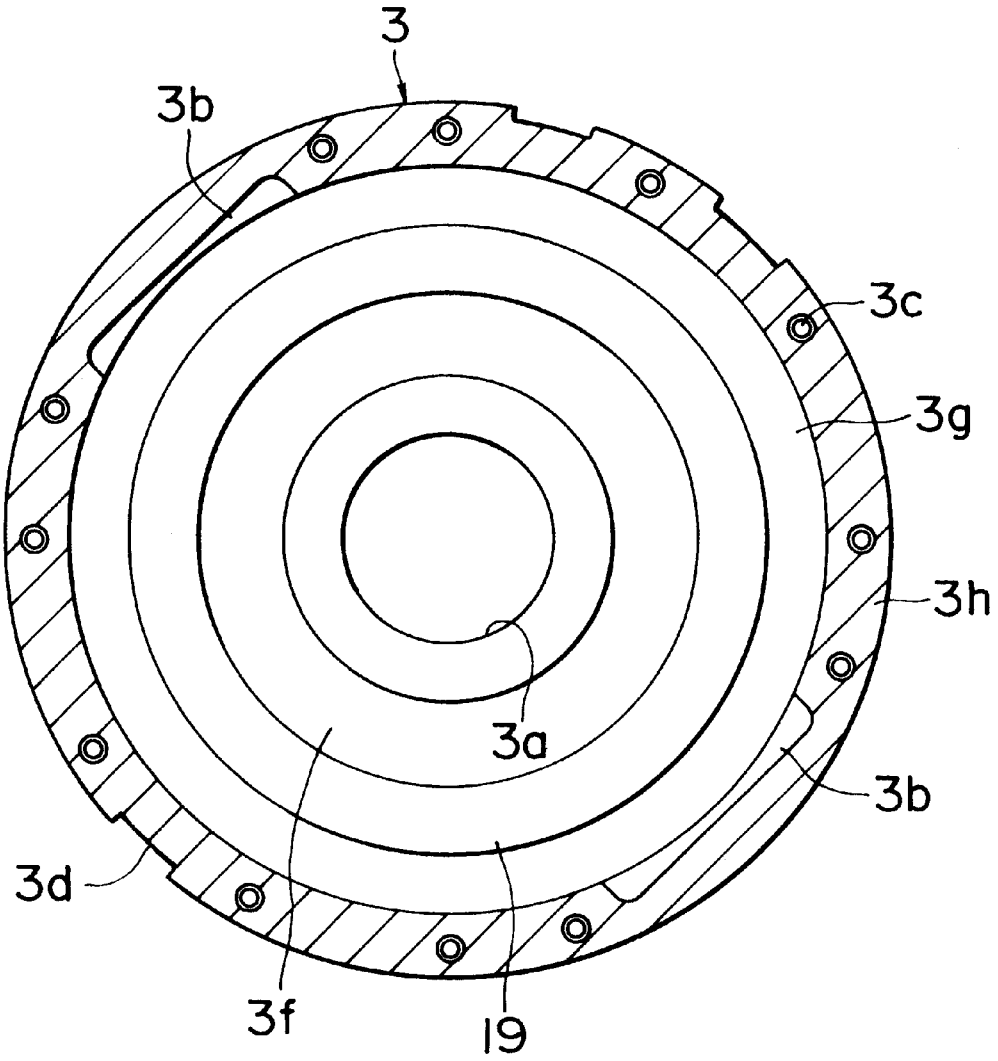
FIG. 17 is a cross sectional view of a frame in the fourth embodiment.

Next, a fourth embodiment in which this invention is applied to a refrigerating and air-conditioning scroll type compressor is described. FIG. 11 shows the overall structure of a scroll type compressor according to this embodiment. FIG. 12 is a perspective view of an Oldham's key, FIGS. 13 and 14 are cross sectional views of an orbiting scroll, FIGS. 15 and 16 are cross sectional views of a first fixed scroll and a second fixed scroll 5, respectively, and FIG. 17 is a cross sectional view of a frame.

The scroll type compressor shown in FIG. 11 comprises a cylindrical closed container 1 both ends of which are closed and which is disposed in such a way that its axis is almost vertical; a frame 3 fixed in the upper portion of the closed container 1 in such a way that its axis is aligned with the axis of the closed container 1; a second fixed scroll 5 fitted in the frame 3 fixed in such a way that its axis is aligned with the axis of the frame 3 and that a wrap 5*a* faces upward; an orbiting scroll 6 disposed over the second fixed scroll 5 in such a manner that a wrap 6*a* is engaged with the wrap 5*a;* a first fixed scroll 4 disposed over the orbiting scroll 6 in such a manner that a wrap 4*a*' is engaged with the wrap 6*a*'; a motor stator 7*a* and a motor rotor 7*b* for driving the orbiting scroll 6, which is disposed below the frame 3 in such a way that their axes are aligned with the first and the second fixed scrolls 4 and 5; a crank shaft 8 fixed in the center of the motor rotor 7*b* for rotationally driving the orbiting scroll 6 via an orbiting bearing 6*b;* a suction pipe 9 disposed so as to penetrate through the wall surface of the closed container 1 for supplying gas to be compressed to a space formed by the wrap 4*a* of the first fixed scroll 4 and the wrap 6*a*' of the orbiting scroll 6; and a discharge pipe 10 disposed so as to penetrate through the wall surface of the closed container 1.

The frame 3 is fixed on the inner circumferential wall surface of the closed container 1, and the first fixed scroll 4 is fixed to the frame 3 by bolts 2 in such a way that the orbiting scroll 6 is sandwiched between the first and the second fixed scrolls 4 and 5 so as to be eccentrically circularly moved around the axis.

The frame 3 has in its center a frame bearing 3*a* fixed concentrically relative to the closed container 1, and also has on its top surface a ring-like convex 3*f* formed concentrically relative to the frame bearing 3*a*. The frame bearing 3*a* has a flanged bearing structure with a flange at the top. An annular groove 19 with an inner-diameter-side wall surface that comprises the outer circumferential wall of the ring-like convex 3*f* is formed on the outer circumferential side of the ring-like convex 3*f* on the top surface of the frame 3, and seal rings 3*e* are formed on the outer and the inner circumferential walls of the ring-like convex 3*f*. The annular groove 19 includes on its outer circumferential side a ring-like plane 3*g* on which the second fixed scroll 5 is mounted, and further outside the ring-like plane 3*g,* a first fixed scroll mounting section 3*h* located higher than the ring-like plane 3*g*.

In FIG. 15, the first fixed scroll 4 includes in its center, a first fixed scroll bearing 4*b* fixed concentrically to the closed container 1 and around the bearing 4*b,* a first fixed scroll wrap (hereafter simply referred to as a "wrap") 4*a* in spiral shape. A discharge hole 4*e* is formed in the position between the first fixed scroll bearing 4*b* and the central terminal portion of the wrap 4*a,* and communicates with a discharge space 1*a* through a discharge passage 4*h*. The outer-most circumferential portion of the first fixed scroll 4 constitutes an annular wall higher than the wrap 4*a,* in which a plurality of tapped holes 4*f* are formed in axial direction. Recesses 4*c* and 4*d* are radially outwardly drilled in the inner circumferential surface of this wall in such a manner that they are opposed with respect to the first fixed scroll bearing 4*b*.

In FIG. 11, the crank shaft 8 acting as a drive shaft comprises a motor shaft 8*d* fixed to the motor rotor 7*b;* a lower supporting shaft 8*b* extending upward from the motor shaft 8*d* and supported by the frame bearing 3*a*; an eccentric shaft 8*a* extending upward from the lower supporting shaft 8*b* and supported by the orbiting bearing 6*b;* an upper supporting shaft 8*c* extending upward from the eccentric shaft 8*a* and supported by the first fixed scroll bearing 4*b* fixed in the center of the first fixed scroll 4; and a lower end supporting shaft 8*e* extending downward from the motor shaft 8*d* and supported by an auxiliary bearing 12 formed in an auxiliary frame 11 fixed to the wall surface of the closed container 1. A central axis of the eccentric shaft 8*a* is offset from central axes of the motor shaft 8*d* and the lower supporting shaft 8*b* by the orbiting radius ϵ. Central axes of the lower supporting shaft 8*b,* the upper supporting shaft 8*c,* the motor shaft 8*d,* and the lower end supporting shaft 8*e* are identical and are aligned with the axis of the closed container 1. The crank shaft 8 also has a lower balance weight 13 on the lower supporting shaft 8*b* and an upper balance weight 14 on the upper supporting shaft 8*c* for canceling the centrifugal force of an orbiting scroll 6 and moments generated by the centrifugal force to prevent vibration. The frame bearing 3*a* has a flanged bearing structure in which the top surface of the flange receives the weight of the crank shaft 8 and the motor rotor 7*b,* which is then transmitted to the frame 3.

The orbiting scroll 6 is restricted by the Oldham's key 15 from rotating around its axis (around the eccentric shaft 8*a*) and rotationally driven to eccentrically move (orbit). The Oldham's key 15 is shaped like the letter T (T-shaped Oldham's key) and comprises a rectangular-plate-like head 15*a,* a cylindrical portion 15*b* stood perpendicular to the head 15*a,* and a through-hole 15*c* provided in the center of the cylindrical portion 15*b,* as shown in FIG. 12. As the orbiting scroll 6 orbits, the cylindrical portion 15*b* of the Oldham's key 15 slides radially through key holes 6*c* and 6*d* formed in the orbiting scroll 6 shown in FIGS. 13 and 14, while the head 15*a* slides circumferentially through recesses 4*c* and 4*d* formed in the first fixed scroll 4 shown in FIG. 15. In this case, the through-hole 15*c* provided in the center of the cylindrical portion 15*b* of the Oldham's key 15 prevents the gas compression in a sealed space which is formed by the cylindrical portion and the key holes when the cylindrical portion 15*b* slides through the key holes 6*c* and 6*d* formed in the orbiting scroll 6.

FIGS. 13 and 15 are cross sectional views of the orbiting and the first fixed scrolls 6 and 4, respectively, according to the embodiments of this invention.

The orbiting scroll 6 has the orbiting bearing 6*b* formed in its center as described in FIG. 4, and also has the wraps 6*a* and 6*a*' formed on both sides of the end plate 6*f* as seen in FIG. 14. The orbiting scroll 6 thus has a double teeth structure. The double teeth structure enables to cancel axial thrusts associated with gas compression each other. The shape of the wraps 6*a* and 6*a*' formed on both sides of the end plate 6*f* is as described in FIG. 4, so its description is omitted. The outside dimension of the end plate of the orbiting scroll 6 can be reduced by aligning the terminal of the outer curve of the orbiting scroll wrap 6*a* with the circumferential edge of the end plate 6*f*. A discharge port 6*e* is provided in the outer circumferential portion of the orbiting bearing 6*b*.

FIG. 15 is a cross sectional view of the first fixed scroll 4 according to the embodiments of this invention. The shape of the wrap 4*a* formed in the first fixed scroll 4 is as shown in FIG. 2, and its description is omitted. A suction port 4*g* in communication with the suction pipe 9 disposed so as to penetrate through the side wall of the closed container 1 is opened near the outer-most circumferential portion of the fixed scroll wrap 4*a* of the first fixed scroll 4. On the other hand, a discharge hole 4*e* is provided in the center of the fixed scroll wrap 4*a* near the first fixed scroll bearing 4*b* so as to communicate with the discharge port 6*e* of the orbiting scroll 6. In addition, as shown in FIG. 11, a discharge passage 4*h* is formed so as to be opened into the discharge hole 4*e* and to communicate with the discharge space 1*a* in the upper part of the closed container 1. A bolt hole 4*f* and a recess 4*i* are provided in the outer circumferential portion of the first fixed scroll 4, and the recess 4*i* forms a communication groove that leads to the discharge pipe 10 gas or lubrication oil discharged into the discharge space la in the upper part of the closed container 1.

FIGS. 16 and 17 are cross sectional views of the second fixed scroll 5 and the frame 3 according to the embodiments of this invention. Cutouts 5*b* and 5*c* are formed in the outer circumferential portion of the second fixed scroll 5 so as to be opposed to the recesses 4*c* and 4*d*, respectively, of the first fixed scroll 4 and to act as a sliding surface for the head 15*a* of the Oldham's key 15. A ring-like recess 5*e* is formed concentrically relative to a frame portion 3*a* of the frame 3 in that surface of the second fixed scroll 5 which is opposed to the frame 3, and a communication hole 5*f* penetrates through the bottom of the ring-like recess 5*e* and compression space 17. A suction port 5*d* is installed near the outer-most circumferential portion of the fixed scroll wrap 5*a* so as to communicate with the suction port 4*g* provided in the first fixed scroll 4, and the suction pipe 9 is in communication with the suction port 4*g* and the suction port 5*d*.

Cutouts 3*b* and 3*b*' are provided on the inner circumferential wall of the first fixed scroll mounting section 3*h* of the frame 3 so as to act as a sliding surface for the head 15*a* of the Oldham's key 15. A tapped hole 3*c* is provided in the position opposed to the bolt hole 4*f* of the first fixed scroll 4. A recess 3*d* extending vertically is formed in a plurality of positions of the outer circumferential wall of the first fixed scroll mounting section 3*h*, and together with the recess 4*i* of the first fixed scroll 4, form a communication groove that leads to the discharge pipe 10 gas or lubricating oil discharged into the discharge space 1*a* in the upper part of the closed container 1.

A section sandwiched by the wrap 6*a* of the orbiting scroll 6 and the wrap 4*a* of the first fixed scroll 4 forms a compression space 16, while a section sandwiched by the wrap 6*a*' and the wrap 5*a* of the second fixed scroll 5 forms the compression space 17. The compression space 17 is in communication with the discharge port 6*e*, while the compression space 16 is in communication with the discharge passage 4*h* via the discharge hole 4*e*.

In the compressor of the above constitution, the orbiting scroll 6 is rotationally driven by the crank shaft 8 to eccentrically move (orbit) with the orbiting radius ϵ. The eccentric movement (orbiting) causes fluid to be compressed to be sucked from the suction pipe 9, compressed in the compression spaces 16 and 17, and after reaching a predetermined pressure (a discharge pressure), discharged from the discharge port 6*e* through the discharge hole 4*e* and the discharge passage 4*h* into the discharge space 1*a* in the upper part of the closed container 1. The fluid is then discharged to the outside of the closed container 1 through the discharge pipe 10.

Next, the release structure of the fixed scroll is explained with reference to FIG. 11.

The ring-like convex 3*f* with the seal ring 3*e* is formed in the second-fixed-scroll-side end surface of the frame 3, and is fitted via the seal ring 3*e* in the ring-like recess 5*e* formed in the second fixed scroll 5 in order to form the actuating space 18 in the ring-like recess 5*e*. The actuating space 18 is connected to the compression space 17 through the communication hole 5*f* formed in the second fixed scroll 5. The pressure in the actuating space 18 can be arbitrarily set unless it is equal to the discharge pressure. That is, it is an intermediate or suction pressure.

During normal operation, the axial end surface of the end plate outer-most circumferential portion of the second fixed scroll 5 is flush with the outer circumferential contact surface of the frame 3, so considering the release amount of the second fixed scroll 5, its axial size is determined so that there is a gap between the ends of the orbiting and the second fixed scroll wraps 6*a*' and 5*a* which is appropriate in terms of performance and reliability. On the other hand, since the axial end surface of the end plate outer circumferential portion of the first fixed scroll 4 is in contact with the axial end surface of the end plate outer circumferential portion of the second fixed scroll 5, a gap that is appropriate in terms of performance and reliability is provided and the length of the orbiting scroll wrap 6*a* is determined based on the length of the second fixed scroll wrap 5*a*.

Next, the setting of the gap between the ends of the orbiting and the second fixed scroll wraps 6*a*' and 5*a* while compressor is operating will be described. There are several axial forces acting on the second fixed scroll 5, and the force that presses the second fixed scroll 5 upward (to the orbiting scroll 6) includes:

(1) force (F1) obtained by multiplying the discharge pressure by an axial projected area of a space 5*g* formed in the center of the second fixed scroll 5 by the crank shaft 8 and the inner circumferential wall surface of the ring-like recess 5*e,*

(2) force (F2) obtained by multiplying an axial projected area of the actuating space 18 by the pressure therein, and (3) force (F3) obtained by multiplying the suction pressure by an axial projected area of a space formed by the outer circumferential wall surface of the ring-like recess 5*e* and the wall surface of the frame 3.

The force that presses the second fixed scroll 5 downward (separates the second fixed scroll 5 from the orbiting scroll 6) includes:

(4) force (F4) obtained by multiplying the pressure in the compression space 17 by an area of the compression space. As a result, the axial force acting on the second fixed scroll 5 is determined by the balance between the resultant force of F1 to F3 and F4. F1, F3, and F4 depend on the operational conditions of the compressor, and the force F2 determines the gap between the ends of the orbiting and the second fixed scroll wraps 6*a*' and 5*a*. In other words, the force F2, that is, the axial projected area of the actuating space 18 or the pressure therein is determined so as to obtain a gap that is appropriate as determined in terms of performance and reliability.

Next, the operation is described. When the scroll compressor of the above configuration is operated, the balance of the forces is set so that $F1+F2+F3 \geqq F4$, and the axial end surface of the end plate outer circumferential portion of the first and the second fixed scrolls 4 and 5 are in slidably contact with the axial end surface of the end plate outer circumferential portion of the orbiting scroll 6, with an appropriate (set) gap value maintained between the ends of the orbiting scroll wraps 6*a* and 6*a*', the second and the first fixed scroll wraps 5*a* and 4*a* and their respective opposite surfaces.

In this case, if a phenomenon such as liquid compression and an abnormal increase in the pressure in the compression space occur, then the balance of forces will be $F1+F2+F3<F4$, and the force that separates the second fixed scroll 5 from the orbiting scroll 6 causes the axial end surface of the end plate outer circumferential portion of the second fixed scroll 5 to be pressed downward by the release amount relative to the axial end surface of the end plate outer circumferential portion of the first fixed scroll 4, thereby avoiding the contact of the end surface of the end plate outer circumferential portion of the second fixed scroll 5 with the end surface of the end plate outer circumferential portion of the orbiting scroll 6 to avoid abnormal loads on this sliding contact surface.

Although in the embodiment in FIG. 11, the second fixed scroll 5 is axially released, this invention is not limited to this aspect and for example, the first fixed scroll 4 may be divided into a scroll and a frame member so that the scroll member can be axially released. As described above, by allowing the first or the second fixed scroll to be axially released from the orbiting scroll, the compressor can be operated with an appropriate gap constantly maintained between the ends of the orbiting and the fixed scroll wraps. If a phenomenon such as liquid compression or an abnormal increase in the pressure in the compression space occurs, the fixed scroll can be released from the orbiting scroll to avoid abnormal loads on the sliding contact surface between the axial end surface of the end plate outer circumferential portion of the orbiting scroll and the axial end surface of the end plate outer circumferential portion of the fixed scroll.

In the prior art, the compressor structure described above has large outside dimension, as is seen in FIG. 11, and its axial penetration structure prevents a sufficient design volume ratio from being obtained. Thus, such a compressor has an optimal structure to which this invention can applied. In addition, as in this embodiment, the use of a T-shaped Oldham's key as a rotation prevention mechanism for the orbiting scroll enables the outside dimension of the compressor to be reduced. In addition, if this invention is applied to a refrigerating and air-conditioning scroll compressor with a required rated power of 5 horsepower, the compressor can have an outer diameter of 160 mm or less. If this invention is applied to a domestic air-conditioning scroll compressor, the compressor can have an outer diameter of 110 mm or less at a required rated power in the order of 1,800 W. If this invention is applied to a scroll compressor for domestic refrigerators, the compressor can have an outer diameter of 90 mm or less at a required rated power in the order of 240 W.

The advantages of this invention on the outside dimension and the design volume ratio have already been described, so other advantages are explained hereinafter.

Figure 18:
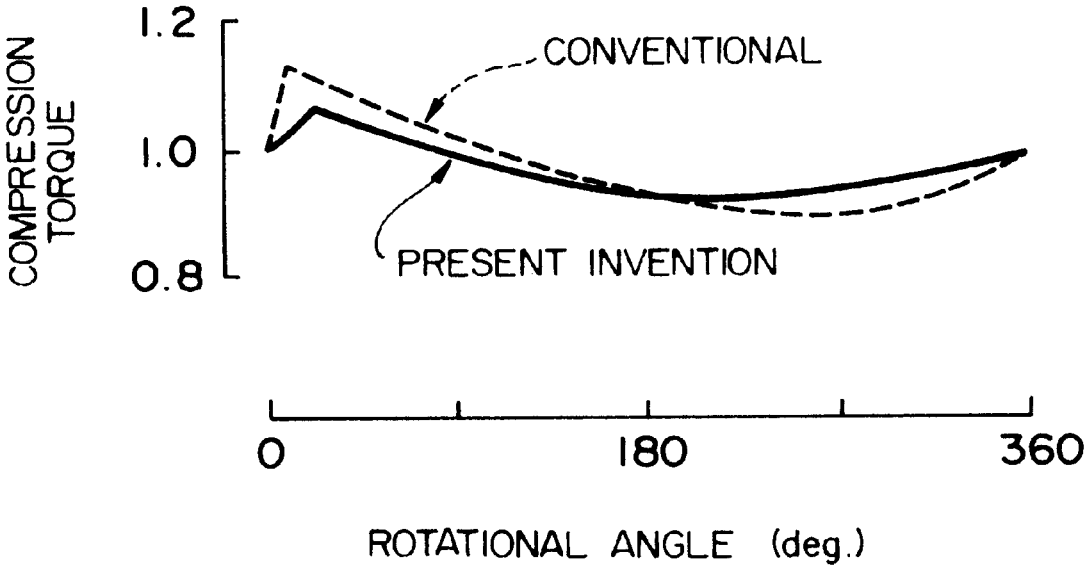
FIG. 18 is a view showing comparison of the compression torque provided in the fourth embodiment to the compression torque provided in conventional techniques.

FIG. 18 shows a comparison of the variation of compression torque associated with gas compression by the compressor relative to the rotational angle of the crank shaft (torque ratio relative to the average torque) under a certain pressure condition and at the same stroke volume, between this embodiment (solid lines) and a conventional example with involute curves (broken lines). For scroll compressors, the compression torque associated with gas compression can be determined by multiplying the tangential gas force at the wrap contact point by the orbiting radius. As is seen in FIG. 18, this embodiment has enabled the variation of compression torque to be reduced than the conventional example with involute curves.

Although in this embodiment, this invention is applied to double-teeth shaft-penetration type scroll compressors, this invention is not limited to such compressors but is effectively applicable to compressors of a single tooth and cantilever structure (the crank shaft does not penetrate).

As described above, according to this embodiment, even in compressors that have large outside dimension and the shaft penetration structure which prevents a sufficient design volume ratio from being obtained, by using the composite curves and the T-shaped Oldham's key as the rotation prevention mechanism of the orbiting scroll, it is possible to obtain a sufficient design volume ratio and to reduce the outside dimension of the compressor and the variation of compression torque.

Although in the above description, the outermost circumference of the basic curve of the scroll wrap comprises a semicircle, it is not necessarily a semicircle but may be a circular arc somewhat smaller or larger than the semicircle. If, for example, a circular arc somewhat smaller than the semicircle is used for the outer-most circumference, there will be a small useless space between the outer circumferential edge of the end plate and the scroll wrap, which is not present when the semicircle is used for the outer-most circumference. This space, however, is small and the wrap can be machined easily, compared to the use of involute curves for the basic curve.

According to this invention, the basic curve of the scroll wrap can be formed of a composite curve comprising a combination of a plurality of circular arcs and straight lines or a plurality of circular arcs in order to make the best use of the space around the outer circumference of the scroll, so the outside dimensions of the compressor can be reduced. In addition, the design volume ratio can be increased without increasing the outside dimension of the scroll. Furthermore, the variation of torque associated with compressive force can be reduced.

What is claimed is:

1. A scroll type fluid machine in which two scroll members each formed of an end plate and a wrap stood upright thereto are engaged with each other with the wraps facing inwardly and in which one of the scroll members orbits around the other scroll member at a predetermined orbiting radius while not apparently rotating around its axis, wherein a basic spiral curve of the wrap of each scroll member comprises a first region formed of a plurality of concentric circular arcs, a second region formed of a plurality of circular arcs having a central angle less than 180°, the centers of which are offset from the center of said concentric circular arcs of said first region, first ends of said concentric circular arcs of said first region being respectively connected to first ends of said circular arcs of said second region, and a third region interconnecting second ends of said concentric circular arcs of said first region to respective second ends of said circular arcs of said second region so that the wraps of both scroll members become spiral.

2. A scroll type fluid machine in which two scroll members each formed of an end plate and a wrap stood upright thereto are engaged with each other with the wraps facing inwardly and in which one of the scroll members orbits around the other scroll member at a predetermined orbiting radius while not apparently rotating around its axis, wherein a basic spiral curve of the wrap of one of the scroll members comprises a first region formed of a plurality of concentric circular arcs, a second region formed of a plurality of circular arcs having a central angle less than 180°, the centers of which are offset from the center of said concentric circular arcs of said first region first ends of said concentric circular arcs of first region being respectively connected to first ends of said circular arcs of said second region, and a third region interconnecting second ends of said concentric circular arcs of said first region to respective second ends of said circular arcs of said second region so that the wraps of both scroll members become spiral, and wherein a basic spiral curve of the wrap of the other scroll is formed of one of two envelopes drawn when the basic spiral curve of the wrap of said one of the scroll members is circularly moved with said orbiting radius.

3. A scroll type fluid machine according to claim 1 or 2, wherein a radius of the end plate of the orbiting scroll member is equal to a radius of an outermost circular arc of the wrap provided thereon.

4. A scroll type fluid machine according to claim 1 or 2, wherein the circular arc of the largest radius is a semicircle.

5. A scroll type fluid machine in which two scroll members each formed of an end plate and a wrap stood upright thereto are engaged with each other with the wraps facing inwardly and in which one of the scroll members orbits around the other scroll member at a predetermined orbiting radius while not apparently rotating around its axis, wherein the basic spiral curve of the wrap of both scrolls is formed by sequentially connecting a semicircle, a circular arc with a center different from that of the semicircle and a central angle less than 180°, and a straight line or a curve connecting said semicircle and said circular arc together.

6. A scroll type fluid machine in which two scroll members each formed of an end plate and a wrap stood upright thereto are engaged with each other with the wraps facing inwardly and in which one of the scroll members orbits around the other scroll member at a predetermined orbiting radius while not apparently rotating around its axis, wherein the basic spiral curve of the wrap of both scrolls is formed of a group of concentric semicircles, a group of circular arcs having centers different from that of the group of semicircles and a central angle less than 180°, and a group of straight lines or curves connecting the group of semicircles and the group of circular arcs together.

7. A scroll type fluid machine according to claim 6, wherein the distance between the centers of said group of circular arcs and the center of said group of semicircles is the predetermined radius.

8. A scroll type fluid machine according to claim 6, wherein the diameter of the outer-most circumferential semicircle of the group of semicircles of the fixed scroll member that is said other scroll member is twice as large as the radius of the outer-most circumferential circular arc of the group of circular arcs of the orbiting scroll member that is said one of the scroll members.

9. A scroll type fluid machine according to claim 6, wherein the central angle of said group of circular arcs is between 90° to 135° and wherein the central angle of said group of straight lines or curves is between 90° to 45°.

10. A scroll type fluid machine according to any one of claims 6 to 9, wherein the diameter of the outermost circumferential semicircle of said group of semicircles is equal to the diameter of the outer circumferential edge of said end plate.

11. A scroll type fluid machine in which two scroll members each formed of an end plate and a wrap stood upright thereto are engaged with each other with the wraps facing inwardly and in which one of the scroll members orbits around the other scroll member at a predetermined orbiting radius while not apparently rotating around its axis, wherein a curve of the wrap of one of the scrolls is formed of a group of concentric semicircles, a group of circular arcs having centers different from that of the group of semicircles and a central angle less than 180°, and a group of straight lines or curves connecting the group of semicircles and the group of circular arcs together, while a curve of the wrap of the other scroll is formed of one of two envelopes drawn when said curve is circularly moved with said predetermined orbiting radius.

12. A scroll type fluid machine in which an orbiting scroll with a wrap provided on either surface of a plate and fixed scrolls are eccentrically combined with one another with the wraps facing one another and in which a drive shaft penetrating through the orbiting and the fixed scrolls causes said orbiting scroll to orbit around said fixed scrolls at a predetermined orbiting radius while not apparently rotating around its axis, wherein a basic spiral curve of the wrap of both scrolls is formed by connecting in line, a semicircle, a circular arc with a center different from that of the semicircle and a central angle less than 180°, and a straight line or a curve connecting said semicircle and said circular arc together.

13. A scroll type fluid machine according to claim 11 or 12, wherein a radius of the plate of the orbiting scroll member is equal to a radius of an outermost semicircle of the wrap provided thereon.

14. A refrigerating air-conditioning scroll compressor with a required rated power in the order of 5 horsepower in which an orbiting scroll with a wrap Provided on either surface of a plate and fixed scrolls are eccentrically combined with one another with the wraps facing one another and in which a drive shaft penetrating through the orbiting and the fixed scrolls causes said orbiting scroll to orbit around said fixed scrolls at a predetermined orbiting radius while not apparently rotating around its axis, wherein a basic spiral curve of the wrap of both scrolls is formed by connecting in line, a semicircle, a circular arc with a center different from that of the semicircle, and a straight line or a curve connecting said semicircle and said circular arc together, wherein each circular arc has a central angle less than 180° and wherein an outer diameter of the compressor is 160 mm or less.

15. A refrigerating air-conditioning scroll compressor according to claim 14, wherein a radius of the plate of the orbiting scroll member is equal to a radius of an outermost semicircle of the wrap provided thereon.

16. A scroll compressor for domestic refrigerators with a required rated power in the order of 240 W in which an orbiting scroll with a wrap provided on either surface of a plate and fixed scrolls are eccentrically combined with one another with the wraps facing one another and in which a drive shaft penetrating through the orbiting and the fixed scrolls causes said orbiting scroll to orbit around said fixed scrolls at a predetermined orbiting radius while not apparently rotating around its axis, wherein a basic spiral curve of the wrap of both scrolls is formed by connecting in line, a semicircle, a circular arc with a center different from that of the semicircle, and a straight line or a curve connecting said semicircle and said circular arc together, wherein each circular arc has a central angle less than 180° and wherein an outer diameter of the compressor is 90 mm or less.

17. A scroll compressor according to claim 16, wherein a radius of the plate of the orbiting scroll member is equal to a radius of an outermost semicircle of the wrap provided thereon.

18. A domestic air-conditioning scroll compressor with a required rated power in the order of 1,800 W in which an orbiting scroll with a wrap provided on either surface of a plate and fixed scrolls are eccentrically combined with one another with the wraps facing one another and in which a drive shaft penetrating through the orbiting and the fixed scrolls causes said orbiting scroll to orbit around said fixed scrolls at a predetermined orbiting radius while not apparently rotating around its axis, wherein a basic spiral curve of the wrap of both scrolls is formed by connecting in line, a semicircle, a circular arc with a center different from that of the semicircle, and a straight line or a curve connecting said semicircle and said circular arc together, wherein each circular arc has a central angle less than 180° and wherein an outer diameter of the compressor is 110 mm or less.

19. A domestic air-conditioning scroll compressor according to claim 18, wherein a radius of the plate of the orbiting scroll member is equal to a radius of an outermost semicircle of the wrap provided thereon.

* * * * *